US005174311A

United States Patent [19]

Fehrmann

[11] Patent Number: 5,174,311

[45] Date of Patent: Dec. 29, 1992

[54] DEVICE FOR THE SHAPING OF HUMAN HAIR

[75] Inventor: Günter Fehrmann, Dänischenhagen, Fed. Rep. of Germany

[73] Assignee: Goldwell A.G., Darmstadt, Fed. Rep. of Germany

[21] Appl. No.: 853,024

[22] Filed: Mar. 18, 1992

Related U.S. Application Data

[63] Continuation of Ser. No. 668,825, Mar. 13, 1991, abandoned.

[30] Foreign Application Priority Data

Mar. 13, 1990 [DE] Fed. Rep. of Germany ..... 4007900

[51] Int. Cl.[5] ..... A45D 1/00

[52] U.S. Cl. ..... 132/269; 132/229; 132/233; 132/271

[58] Field of Search ..... 132/204, 205, 206, 207, 132/220, 229, 230, 233, 234, 269, 271; 219/222, 225, 226

[56] References Cited

U.S. PATENT DOCUMENTS

| | | | |
|---|---|---|---|
| 1,824,799 | 9/1931 | Adam et al. | 132/229 |
| 1,901,892 | 3/1933 | Bjorkman et al. | 132/229 |
| 1,922,061 | 8/1933 | Ströher | 132/229 |
| 1,946,812 | 2/1934 | Shelton | 132/229 |
| 1,946,813 | 2/1934 | Shelton | 132/229 |
| 1,990,528 | 2/1935 | Davis | 219/222 |
| 2,052,353 | 8/1936 | Kiss | 132/229 |
| 2,114,917 | 4/1938 | Durham | 132/229 |
| 3,560,704 | 2/1971 | Albert | 132/229 |
| 3,617,694 | 11/1971 | D'Entremont | 132/229 |
| 3,617,695 | 11/1971 | Meyer et al. | 132/229 |
| 3,673,382 | 6/1972 | Gaffney et al. | 132/229 |
| 3,689,736 | 9/1972 | Meyer | 132/229 |
| 4,829,155 | 5/1989 | Fukutuka et al. | 219/222 |
| 4,829,156 | 5/1989 | Thompson | 219/230 |

*Primary Examiner*—Gene Mancene
*Assistant Examiner*—Frank A. LaViola
*Attorney, Agent, or Firm*—Birch, Stewart, Kolasch & Birch

[57] ABSTRACT

A device to shape human hair whereby possibly premoistened hair is wound up in strands on curlers onto which a liquid or consistent permanent waving product is applied and processed with heat energy added to the hair curlers for a predetermined time. The permanent reshaping product is then rinsed and possibly after an additional treatment with liquid neutralizer and rinsing of the same, the curlers will be removed from the hair. After winding of the hair strands and application of the permanent waving preparation, the curlers are heated by a short-time application of energy to a predetermined temperature. The heat stored by the curlers will then be transferred from the curlers to the hair curls treated with the permanent waving preparation.

14 Claims, 2 Drawing Sheets

DEVICE FOR THE SHAPING OF HUMAN HAIR

This application is a continuation of application Ser. No. 07/668,825, filed on Mar. 13, 1991, now abandoned.

BACKGROUND OF THE INVENTION

1. Field of the Invention

The present invention relates to a device which shapes human hair. More particularly, the present invention relates to an internally heated curler for shaping human hair.

2. Description of Related Art

During the permanent reshaping of human hair with the use of heat, active components of the permanent waving preparation (e.g. thioglycolates) split hair keratin into HS-groups by a reductive process in connection with added heat. Rinsing of the permanent waving preparation is followed by a neutralization, i.e. preferably by a liquid oxidant on the basis of hydrogen peroxide which re-combines the HS-groups to disulfide bonds. As a rule hot air or radiator heat promote and increase the action of the permanent waving preparation, but it also means some discomfort for the person treated, and it is obvious that the temperature of the operating hot air or radiator heat must not be selected too high in order to avoid damage or undue inconvenience to the person treated. At any rate, the hair structure is damaged by a permanent wave treatment to some degree.

OBJECTS AND SUMMARY OF THE INVENTION

An object of the invention is to modify the known permanent waving process in a way to enable a more convenient procedure for the person treated and at the same time decrease the extent of damage to the hair structure.

This and other objects are provided by a device which shapes human hair, whereby the hair, possibly premoistened, is wound up in strands on hair curlers to which a liquid or consistent perming preparation such as a cream or gel is applied and heat energy is added onto the curlers to act for a predetermined period, whereafter the permanent reshaping product is rinsed out. After a further possible additional application of a liquid neutralizing product and its rinsing, the curlers are removed from the hair.

Based on the procedure mentioned initially in the invention, the object of the invention is solved whereby after winding the hair strands onto curlers and applying the perming preparation, a short-term supply of heat energy in a predetermined range of temperature is directed to the curlers, and then the heat energy stored in the curlers is transferred onto the hair curls which have the permanent preparation already applied. In other words heat is applied not by blowing or radiation for a longer processing time but by the curler, i.e. through an inner part of the curler, enabling in actual fact higher temperatures on the curls, without causing scalp burning of the treated person. Due to the higher temperature in action, it is possible to use perming preparations with a lower share of reducing components (e.g. thioglycolates), so that the permanent waving process of this invention may be performed in shorter periods and with less damage to the hair structure.

It is advantageous to heat the curlers between 55° to 95° C., preferably between 75° to 85° C. whereby this range may also be exceeded or fallen below in consideration of different hair textures or hair damage and/or in adaptation to perming preparation with varying active agents or concentrations.

To perform the procedure, a number of hair curlers are planned holding electric resistance heaters fitted for connection to electric power, with electric connections at the outer sides of the curlers and a contact mechanism connected to the electric power which may be manually connected to and disconnected from the curler. Thus, heating up of the curlers happens after winding the hair and after application of the perming preparation and takes place by connecting the contact element to the curlers for a short time each, whereby the curlers are heated to the predetermined temperature, and thereafter the heat is released again with a time lag depending on the heat storage capacity of the curler.

The resistance heating elements used within the curlers are preferably low temperature heating elements, having a positive temperature coefficient. This means that they have a lower electric resistance at normal ambient temperatures, such that after connection to an electric contact they draw electric energy rapidly and heat up very quickly and nearly spontaneously. With rising temperature, upon reaching a predetermined temperature range, resistance increases and the rapid temperature increase slows down distinctly.

For the curlers of the present invention, resistance heating elements are preferably used with a temperature resistance-characteristic showing a strong rise of the electric resistance at a temperature of distinctly in excess of 75° to 85° C. and where the planned temperature range is attained in a very short time.

To ensure that the predetermined temperature will not be exceeded, this invention is extended to a time control system by a pair of curler connections each which operates when a pair of curlers is connected to the wiring, and switches off the power supply to the curler after a predetermined short period ensuring the time to heat up the curler just to a given temperature. For example, by a program controlled timing of varying contact times, power supply may be controlled, and this way heating of the curlers to differing high temperatures may be attained.

Alternatively or additionally, each curler may be provided with a superheating control switch for interrupting the power supply from the contact element connected to the curler when reaching a predetermined temperature of the resistance heating element.

To ensure that the connection of the contact element to one or the other curler will not be overlooked during a perming treatment, it is recommended to place a cover onto the surface of the curlers, at least by sector, to produce a distinct color change of the cover when the set point of the temperature is reached. Lacquers or foils, too, producing a color change caused by temperature influence are available. A curler which has not yet been heated may thus be recognized at a glace.

Curler connections may be provided at the front end of the curlers whereby the curler connections and their relevant contacts of the contact element are suitably shaped as two-pole contacts.

Alternatively, curler connections may also be led to the opposite front ends of each of the curlers, where the contact element is then shaped like a pair of contact clamps with two arms each on the opposite front ends to place the curlers and to open the contact to each curler connection.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

DETAILED DESCRIPTION OF PREFERRED EMBODIMENTS

Figures 1, 3, 4, 5, 6:
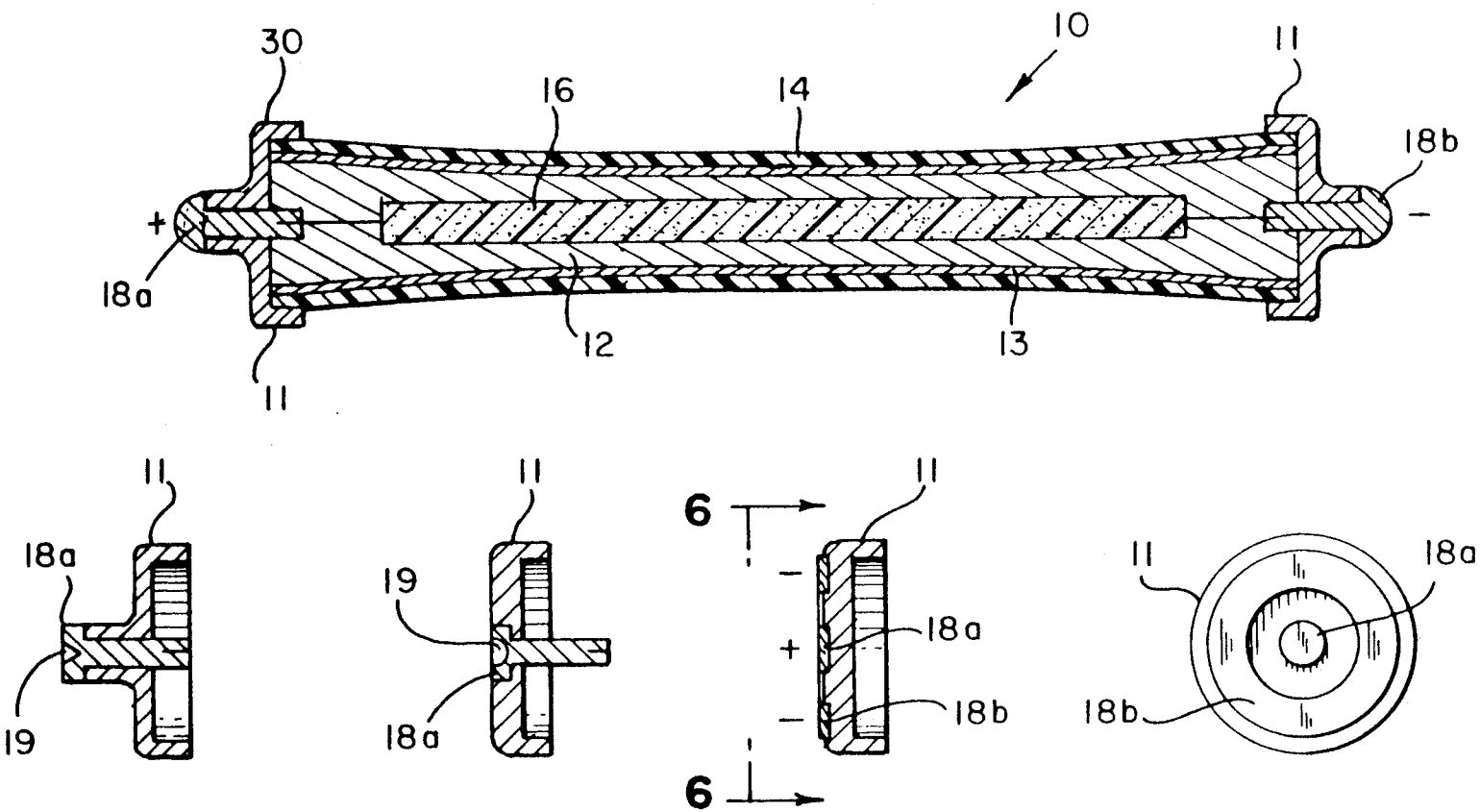
FIG. 1 shows a longitudinal cross section through one electrically heated curler according to the present invention.
FIG. 3 shows a slightly modified curler from the FIG. 1 curler, containing a front cap fitted with a connection contact.
FIG. 4 shows a front cap for a curler with a further modified connection contact.
FIG. 5 shows a front cap of a curler on which both connection contacts are provided for power supply to a resistance heating element.
FIG. 6 shows a front cap viewed in the direction of arrow 6 in FIG. 5.

Referring first to FIG. 1, there is shown a curler at 10 which has an unusually elongated and spindle-shaped external form. The curler 10 is of the type used for permanent waving and may be manufactured in various lengths and diameters.

Curler 10 includes an electric resistance heating element 12 with a positive temperature coefficient which is longitudinally and internally formed therein. Surrounding the heating element 12 is a sufficiently heat proof and heat conducting insulating compound 16. An exterior light alloy metal cartridge 13 houses the heating element 12 and an insulating compound 16. An outer surface of the metal cartridge 13 is protected against the aggressiveness of permanent waving preparations by a plastic coating 14.

In operation, the insulating compound 16 conducts heat generated by the resistance heating element 12 to the plastic coated cover element 14 and disposes of a predetermined heat storage potential therethrough.

Figure 2:
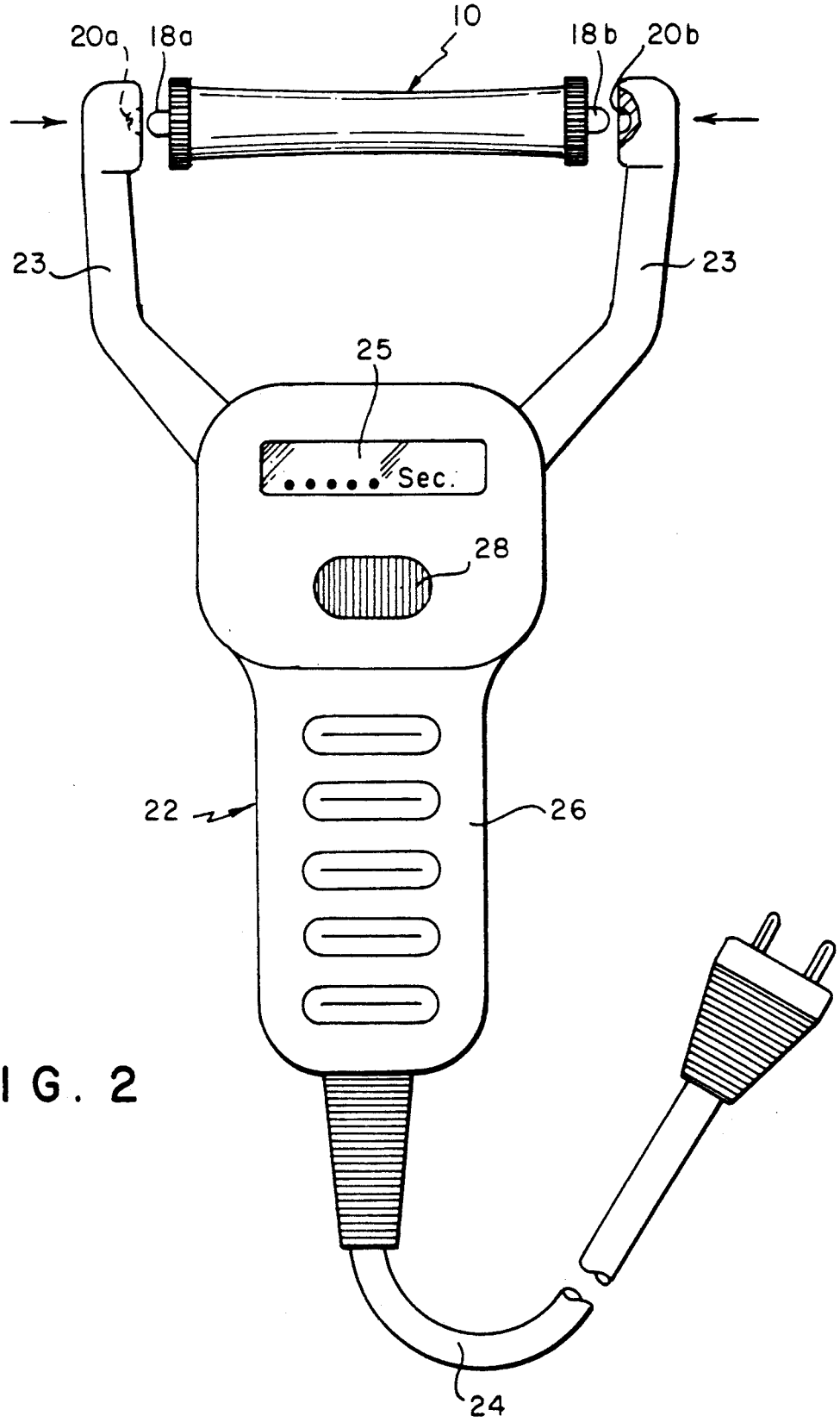
FIG. 2 illustrates a schematic view of a clamp-type contact element enabling electric power supply to the curler shown in FIG. 1.

Referring also to FIG. 2 the resistance heating element 12 includes connection contacts 18*a*, 18*b* protruding from respective end caps 11 on opposing ends of the curler 10. Coordinated contact connections 20*a*, 20*b* are recessed within respective opposing clamp arms 23 of a contact element 22. The pair of contact clamps 23 are connected to an electric power supply by means of electric wiring and through a power supply unit housed within a handle 26 of the contact element. For safety reasons, the voltage passing through contact element 22 is stepped down to a harmless value.

The power supply unit housed within the handle 26 may also provide for a time control which will be activated whenever the contact element 22 connected to the curler 10 is switched on by a press-button 28. In other words, subsequent to engagement of the clamp arms 23 with connection contacts 18*a* and 18*b*, a timing of the electric power supply will be displayed by an adjustable and controllable liquid-crystal indicator 25 in response to the time control to the extent that a single operation of press-button 28 will only heat the curler 10 on the outer surface of its cover unit 14 to a desired temperature between 75° and 85° C.

A cold conductor is preferably as the used resistance heat in element 12, so that this temperature will be reached in a period of 1 to 2 seconds thereby achieving an "impulse heating" of the curler. To avoid overheating of the curler by excessive multiple operations of press-button 28, each curler may additionally be provided with (or also in place of a time control switch in the power pack) a superheating switch which is, for example, formed as a bimetallic switch situated between the connection contacts 18*a* or 18*b* and the resistance heating element 12.

The entire surface of the cover 14 and/or any end caps 11 visible after winding up the hair strands may be covered by a coating such as a thermo-sensitive lacquer or foil which shows distinct color change at a predetermined temperature enabling a visual determination as to whether a certain curler has already been activated by heat or not. On curler 10 shown in FIG. 1, this coating is a punctual dot of an appropriate thermo-sensitive lacquer positioned on the left front cap 11. Alternatively, the end cap 11 may contain a thermo-sensitive circle around protrusion 18*a* on the cap 11.

It is obvious within the background of this invention that amendments and improvements of its procedure or components of the process to perform it may be realized which are related to the arrangement of connection contacts on the curlers and the shape of these contacts and of the accompanying contact elements, as well. FIGS. 3 and 6 illustrate possible modifications of the shapes and arrangements of connection contacts 18*a* or 18*b* of curler 10. In this way FIG. 3 illustrates a front cap 11 with a connection contact 18*a* which, instead of the spherical segment planned in FIG. 1, has within its outer shape an indentation 19 which fits appropriately in a complementary protuding part of the contact connection 20*a* of the contact element 22.

FIG. 4 illustrates the arrangement of a connection contact 18*a* in end cap 11 where the connection contact 18*a* is made flush with the level flat part of the end cap 11, holding again an indentation 19 to fit a complementary protuding part of the contact connection 20*a* of contact element 22.

All examples illustrated in FIGS. 1–4 are based on the fact that the contact element is shaped like a pair of contact clamps with two mobile, oppositely positioned tong arms 23 to accommodate curler 10 on the opposite ends thereof.

FIGS. 5 and 6 now illustrate an end cap 11 whereby the two connection contacts 18*a* and 18*b* are shaped like a centric, metallized connection surface 18*a* and a concentrically made outer circle-shaped connection surface 18*b*. To heat curler 10 fitted with such an end cap 11, will necessitate the development of an adequately modified contact element (not shown) which is placed at one side of the contact end cap 11 of the curler, and is suitably held in place by an appropriately developed notch in the contact element of the front cap.

It will be obvious that the invention renders possible amendments and improvements to the above described examples. Instead of the described curlers on which the hair is wound up, one modification is to use hair clamps to accommodate between their levers wound-up hair or hair placed in waves. However, it is important that these hair clamps, too, may be suitably heated to the desired temperature by a short-term supply of energy.

I claim:

1. A curling rod for heat processing waving solution applied to wrapped hair comprising:

means for generating interior heat within said curling rod, the interiorly generated heat being transferred to an external surface of said curling rod;

first contact members connected to opposing longitudinal ends of said means for generating interior heat;

a manually operable power unit, said power unit including second contact members selectively engageable with said first contact members, respectively, for transmitting electrical power from said power unit to said means for generating interior heat, wherein heat processing of the waving solution applied to the wrapped hair is only from the external surface of said curling rod; and manually operable clamp arms electrically connected to said power unit, wherein said second contact members are disposed in distal ends of said clamp arms for selective engagement with said first contact members, respectively.

2. The apparatus according to claim 1, wherein said means for generating interior heat is selected with a temperature resistance characteristic whereby an increase in electric resistance occurs at a temperature in excess of a range between 75° to 85° C.

3. The apparatus according to claim 1, further including a timer, said timer being activated upon electrical connection between said first and second contact members, respectively, whereby electrical power is terminated after a predetermined interval of said timer.

4. The apparatus according to claim 1, further including a superheating switch, whereby said switch is automatically operated to terminate power supply from said power unit upon reaching a predetermined temperature within said means for generating interior heat.

5. The apparatus according to claim 1, wherein at least a portion of said curler is coated to show a distinct color change when a predetermined temperature is reached at an external surface thereof.

6. The apparatus according to claim 1, wherein said first contact members are constructed as two-pole contact connections.

7. The apparatus according to claim 1, wherein said means for generating heat is an electric resistance heating element.

8. The apparatus according to claim 7, wherein said electric resistance heating element exhibits a positive temperature coefficient.

9. The apparatus according to claim 7, wherein said electric resistance heating element is selected with a temperature resistance characteristic whereby an increase in electric resistance occurs at a temperature in excess of a range between 75° to 85° C.

10. The apparatus according to claim 9, further including a timer, said timer being activated upon electrical connection between said first and second contact members, respectively, whereby the electrical connection is terminated after a predetermined interval of said timer.

11. The apparatus according to claim 7, further including a superheating switch, whereby said switch is automatically operated to terminate power supply from said power unit upon reaching a predetermined temperature within said resistance heating element.

12. The apparatus according to claim 7, wherein at least a portion of said curler is coated to show a distinct color change when a predetermined temperature is reached at an external surface thereof.

13. The apparatus according to claim 7, wherein said first contact members are constructed as two-pole contact connections.

14. A method for shaping human hair comprising the sequentially ordered steps of:

(a) pre-moistening and winding hair in strands on a plurality of curlers;

(b) applying a perming preparation to the hair wound on curlers;

(c) heating an internal heating element within each of said plurality of curlers for a predetermined time and to a predetermined temperature, thereby generating heat to an external surface of said plurality of curlers and causing a heat processing of the perming preparation;

(d) rinsing said perming preparation from the hair wound on curlers;

(e) neutralizing the hair wound on curlers with a neutralizing solution; and (f) removing the hair from each of said plurality of curlers.

* * * * *